US009091495B2

(12) United States Patent
Lee

(10) Patent No.: US 9,091,495 B2
(45) Date of Patent: Jul. 28, 2015

(54) COOLING PASSAGE INCLUDING TURBULATOR SYSTEM IN A TURBINE ENGINE COMPONENT

(71) Applicant: Ching-Pang Lee, Cincinnati, OH (US)

(72) Inventor: Ching-Pang Lee, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 52 days.

(21) Appl. No.: 13/893,392

(22) Filed: May 14, 2013

(65) Prior Publication Data

US 2014/0338866 A1 Nov. 20, 2014

(51) Int. Cl.

| | |
|---|---|
| ***F28F 13/12*** | (2006.01) |
| ***F01D 5/18*** | (2006.01) |
| *F04D 29/38* | (2006.01) |

(52) U.S. Cl.

CPC ..... *F28F 13/12* (2013.01); *F01D 5/187* (2013.01); *F05D 2260/22141* (2013.01)

(58) Field of Classification Search

CPC ..... F01D 5/188; F01D 5/189; F01D 5/187; F01D 2260/22141; Y02T 50/676; F28F 13/12

USPC ..... 165/109.1, 179, 185; 416/96 R, 97 R; 415/115

See application file for complete search history.

(56) References Cited

U.S. PATENT DOCUMENTS

| | | | | |
|---|---|---|---|---|
| 4,514,144 | A | 4/1985 | Lee | |
| 4,627,480 | A | 12/1986 | Lee | |
| 5,052,889 | A | 10/1991 | Abdel-Messeh | |
| 5,361,828 | A | 11/1994 | Lee et al. | |
| 5,395,212 | A * | 3/1995 | Anzai et al. | 416/97 R |
| 5,681,144 | A | 10/1997 | Spring et al. | |
| 5,700,132 | A * | 12/1997 | Lampes et al. | 416/97 R |
| 5,797,726 | A * | 8/1998 | Lee | 416/96 R |
| 6,089,826 | A | 7/2000 | Tomita et al. | |
| 6,227,804 | B1 * | 5/2001 | Koga et al. | 416/96 R |
| 6,331,098 | B1 | 12/2001 | Lee | |
| 6,554,571 | B1 | 4/2003 | Lee et al. | |
| 7,094,031 | B2 | 8/2006 | Lee et al. | |
| 7,866,947 | B2 | 1/2011 | Pietraszkiewicz et al. | |
| 8,419,365 | B2 * | 4/2013 | Kizuka et al. | 416/96 R |

(Continued)

FOREIGN PATENT DOCUMENTS

EP 0939196 A2 9/2009

OTHER PUBLICATIONS

Ching-Pang Lee; U.S. Appl. No. 13/417,714, filed Mar. 12, 2012; entitled Turbine Airfoil With an Internal Cooling System Having Vortex Forming Turbulators.

*Primary Examiner* — Tho V Duong

(57) ABSTRACT

A cooling passage defined between first and second spaced apart sidewalls of a turbine engine component includes a turbulator system including a plurality of rows of turbulator members. Each row includes a first side turbulator member extending from the first sidewall, and a second side turbulator member extending from the second sidewall. The first and second side turbulator members are arranged such that a space is defined therebetween. The first and second side turbulator members are staggered with respect to one another such that respective forward and aft ends thereof are offset from one another. Each row further includes at least one elongate intermediate turbulator member located at least partially in the space between the respective first and second side turbulator members.

16 Claims, 5 Drawing Sheets

(56) References Cited

U.S. PATENT DOCUMENTS

2006/0171808 A1* 8/2006 Liang ..... 416/97 R
2006/0239820 A1 10/2006 Kizuka
2009/0087312 A1* 4/2009 Bunker et al. ..... 416/95
2013/0236330 A1 9/2013 Lee

* cited by examiner

COOLING PASSAGE INCLUDING TURBULATOR SYSTEM IN A TURBINE ENGINE COMPONENT

FIELD OF THE INVENTION

The present invention relates to a turbulator system in a turbine engine, and more particularly, to turbulator system provided in a cooling passage of a turbine engine component and including a plurality of rows of turbulator members.

BACKGROUND OF THE INVENTION

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoil assemblies, e.g., stationary vanes and rotating blades within the turbine section, must be cooled with cooling fluid, such as air discharged from a compressor in the compressor section, to prevent overheating of the components.

SUMMARY OF THE INVENTION

In accordance with a first aspect of the present invention, a cooling passage defined between first and second spaced apart sidewalls of a turbine engine component is provided. The first and second sidewalls extend generally in a first direction with a second direction defined between the first and second sidewalls. The cooling passage comprises a turbulator system including a plurality of rows of turbulator members. Each row comprises a first side turbulator member extending from the first sidewall at an angle of about 15 degrees to about 75 degrees relative to the first direction, and a second side turbulator member extending from the second sidewall at an angle of about −15 degrees to about −75 degrees relative to the first direction. The first and second side turbulator members are arranged such that a space having a component in the second direction is defined therebetween. The first and second side turbulator members are staggered with respect to one another in the first direction such that respective forward and aft ends thereof are offset from one another in the first direction. Each row further comprises at least one elongate intermediate turbulator member having a direction of elongation at least partially extending in the second direction and located at least partially in the space between the first and second side turbulator members. Forward and aft ends of the at least one intermediate turbulator member are staggered with respect to the forward and aft ends of both of the respective first and second side turbulator members in the first direction.

In accordance with a second aspect of the present invention, an airfoil is provided in a turbine engine comprising a main body including a leading edge, a trailing edge, a pressure sidewall, a suction sidewall, and a hollow interior portion. The airfoil further comprises opposed first and second sidewalls in the hollow interior portion and extending generally parallel to one another in a first direction with a second direction defined between the first and second sidewalls. The first and second sidewalls define a cooling passage therebetween, wherein a turbulator system provided in the cooling passage. The turbulator system includes a plurality of rows of turbulator members, each row comprising a first side turbulator member extending from the first sidewall at an angle of about 15 degrees to about 75 degrees relative to the first direction, and a second side turbulator member extending from the second sidewall at an angle of about −15 degrees to about −75 degrees relative to the first direction. The first and second side turbulator members are arranged such that a space having a component in the second direction is defined therebetween. The first and second side turbulator members are staggered with respect to one another in the first direction, such that respective forward and aft ends thereof are offset from one another in the first direction. Each row further comprises at least one elongate intermediate turbulator member located at least partially in the space between the first and second side turbulator members.

Forward and aft ends of the at least one intermediate turbulator member are staggered with respect to the forward and aft ends of both of the respective first and second side turbulator members in the first direction. At least a majority of the rows have generally the same configuration of turbulator members.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
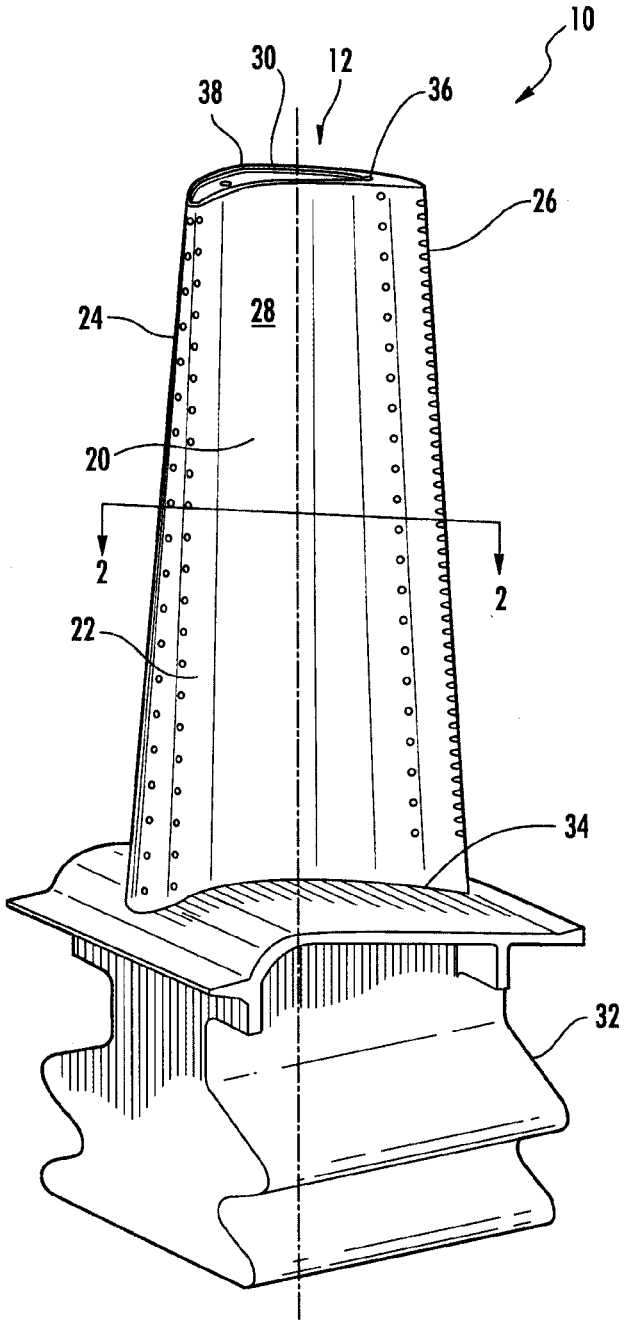
FIG. 1 is a perspective view of an airfoil assembly including a cooling system according to an embodiment of the invention.
Figure 2:
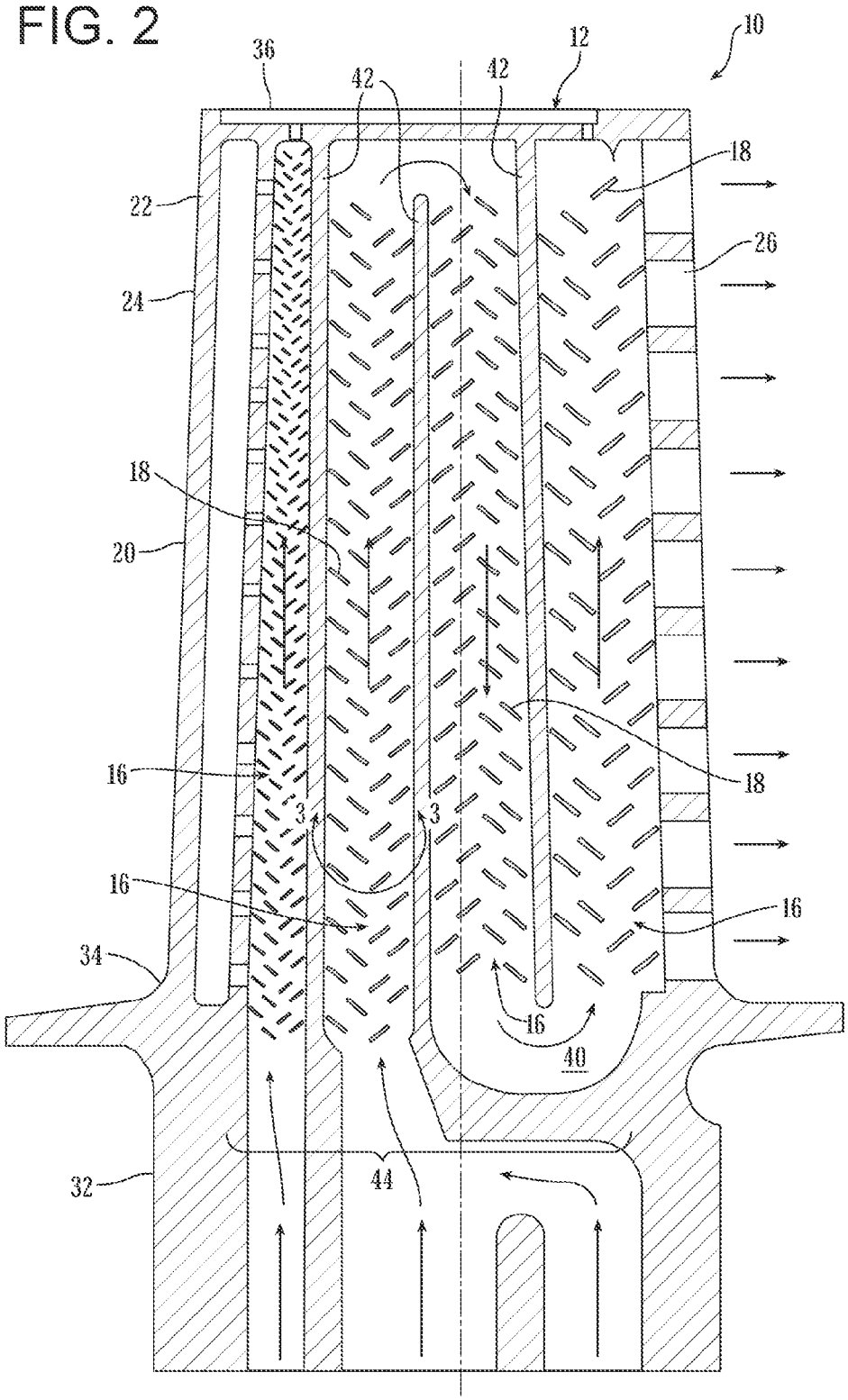
FIG. 2 is a side cross sectional view of the airfoil assembly of FIG. 1 showing the cooling system, taken from line 2-2.
Figure 3:
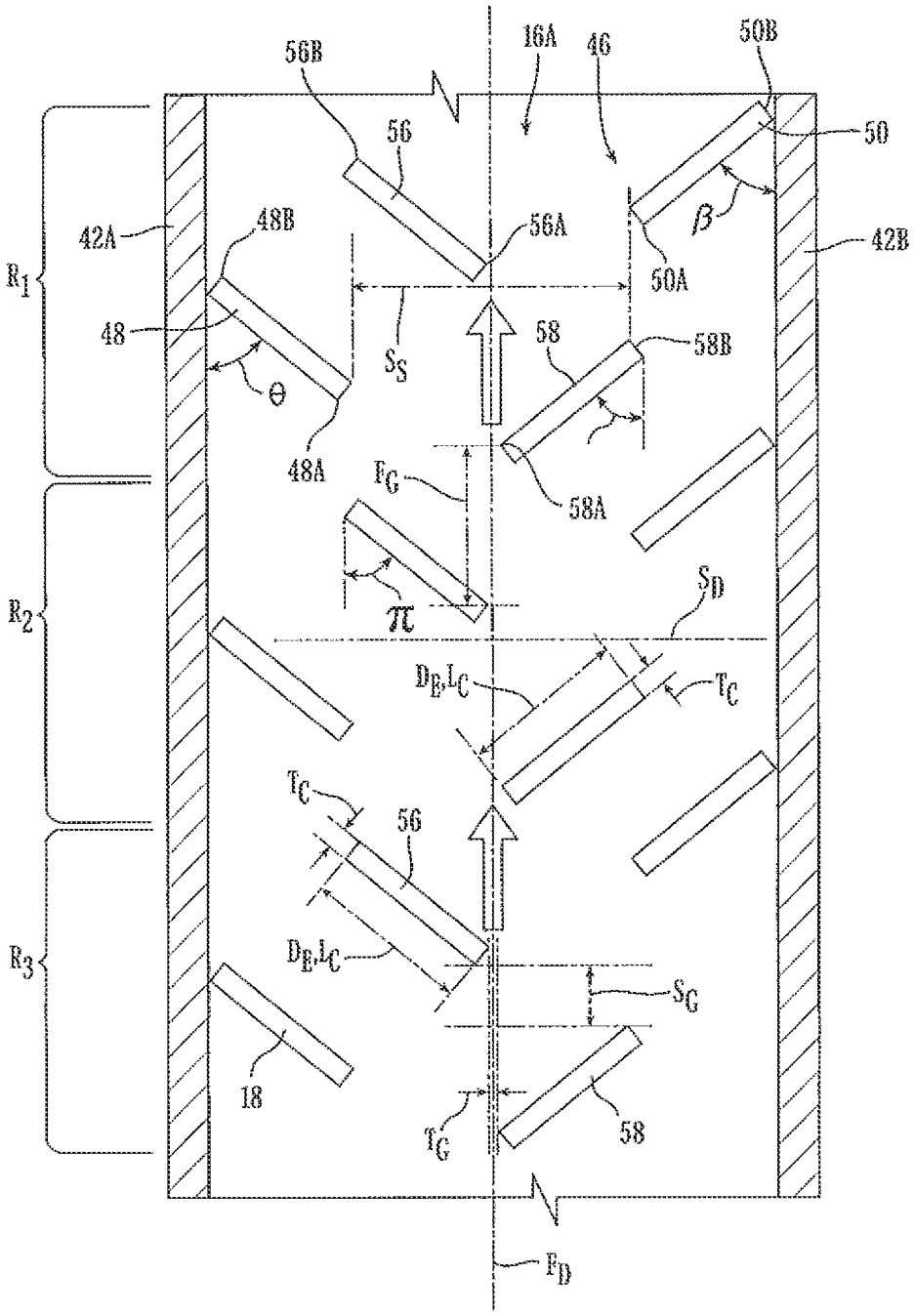
FIG. 3 is an enlarged view showing a portion of the cooling system of FIG. 2.

As shown in FIGS. 1-3, this invention is directed to a turbine airfoil cooling system 10 configured to cool internal and external aspects of a turbine airfoil 12 usable in a turbine engine, such as a gas turbine engine. In at least one embodiment, the turbine airfoil cooling system 10 may be configured to be included within a turbine blade, as shown in FIGS. 1-3. While the description below focuses on a cooling system 10 in a turbine blade 12, the cooling system 10 may also be adapted to be used in a stationary turbine vane or in other turbine engine components that include cooling passages. The turbine airfoil cooling system 10 may comprise one or more cooling passages 16 or cooling channels having any appropriate configuration, as shown in FIGS. 2 and 3. The cooling passages 16 may include a plurality of turbulator members 18 for creating vortices within the cooling passages 16 to increase the internal cooling potential of the cooling system 10, thereby increasing the overall performance of the cooling system 10, as will be described herein.

Referring to FIGS. 1 and 2, the exemplary turbine airfoil 12 shown comprises a generally elongated hollow airfoil 20 formed from an outer wall 22. The generally elongated hollow airfoil 20 includes a leading edge 24, a trailing edge 26, a pressure side 28 (see FIG. 1), a suction side 30 (see FIG. 1), a dovetail 32 at a first end 34 of the airfoil 20 and a tip 36 at a second end 38 opposite to the first end 34. The generally elongated hollow airfoil 20 may have any appropriate configuration and may be formed from any appropriate material.

As shown in FIG. 2, the cooling system 10 may be positioned within interior aspects of the generally elongated hollow airfoil 20. One or more cooling passages 16 of the cooling system 10 may be positioned in the generally elongated hollow airfoil 20 and formed from an inner surface 40. The inner surface 40 may define, with elongate spanning structures 42 that form cooling passage sidewalls, the cooling passages 16. The cooling passages 16 may have any appropriate cross-sectional shapes, and may be positioned near the leading edge 24, at a mid-chord section 44, and/or near the trailing edge 26.

One of the cooling passages 16 according to an aspect of the invention will now be described, it being understood that others of the cooling passages 16 may be substantially similar or identical to the cooling passage 16 described.

Referring to FIG. 3, first and second ones 42A, 42B of the spanning structures 42 form first and second sidewalls 42A, 42B, which define a first cooling passage 16A of the cooling system 10 therebetween. The opposed first and second sidewalls 42A, 42B extend generally parallel to one another and define a first direction $F_D$ with a second direction $S_D$ defined between the first and second sidewalls 42A, 42B. It is noted that the terms "forward", "aft", "radial", "axial", "circumferential", "first direction", "second direction", and the like, as used herein, are not intended to be limiting with regard to orientation of the elements recited for the present invention.

The first cooling passage 16A of the cooling system 10 comprises a turbulator system 46 including a plurality of rows $R_1, R_2, \ldots R_N$ of turbulator members 18 (only three partial rows $R_1, R_2, R_3$ are shown in FIG. 3). Each row $R_1, R_2, \ldots R_N$ comprises a first side turbulator member 48 extending from the first sidewall 42A at an angle θ of about 15 degrees to about 75 degrees relative to the first direction $F_D$, and a second side turbulator member 50 extending from the second sidewall 42B at an angle β of about −15 degrees to about −75 degrees relative to the first direction $F_D$. The phrase "extending from" as used herein is meant to encompass the first and second side turbulator members 48, 50 extending directly from the respective sidewalls 42A, 42B, i.e., wherein there is no gap or space therebetween, or the first and second side turbulator members 48, 50 extending from the respective sidewalls 42A, 42B with a small gap or space, i.e., a gap or space equal to or less than about the thickness of the first and second side turbulator members 48, 50, therebetween.

According to aspects of the invention, the first and second side turbulator members 48, 50 in each row $R_1, R_2, \ldots R_N$ may be generally oppositely angled with respect to one another relative to the first direction $F_D$. Further, the first and second side turbulator members 48, 50 may be staggered with respect to one another in the first direction $F_D$, such that respective forward and aft ends 48A, 48B, 50A, 50B thereof are offset from one another in the first direction $F_D$.

As shown in FIG. 3, the first and second side turbulator members 48, 50 are arranged such that a space $S_S$ having a component in the second direction $S_D$ is defined therebetween. Each row $R_1, R_2, \ldots R_N$ further comprises a pair of elongate intermediate turbulator members 56, 58, which are each located at least partially in the space $S_S$ between the respective first and second side turbulator members 48, 50, each intermediate turbulator member 48, 50 having an inner end being a forward end 56A, 58A located closer to the middle of the cooling channel 16A and an outer end being an aft end 56B, 58B located closer one of the respective side walls 42A, 42B. The first and second side turbulator members 48, 50 and the intermediate turbulator members 56, 58 are each generally rectangular in shape, i.e., each turbulator member has walls that are generally perpendicular to each other to provide the turbulator members 48, 50, 56, 58 with generally squared corners. The intermediate turbulator members 56, 58 each have a direction of elongation $D_E$ at least partially extending in the second direction $S_D$, wherein length components $L_C$ of the intermediate turbulator members 56, 58, which are defined along the direction of elongation $D_E$ thereof, are at least about 5× thickness components $T_C$ of the intermediate turbulator members 56, 58. Further, in the embodiment shown in FIG. 3, the forward and aft ends 56A, 56B, 58A, 58B of the intermediate turbulator members 56, 58 are staggered with respect to each other in the first direction $F_D$, such that the respective forward and aft ends 56A, 56B, 58A, 58B thereof are offset from one another in the first direction $F_D$, and wherein a gap $F_G$ extending in the first direction $F_D$ is formed between the forward ends 56A, 58A of the respective first and second intermediate turbulator members 56, 58 in each row $R_1, R_2, \ldots R_N$. The configuration of the intermediate turbulator members 56, 58 also results in a gap $S_G$ extending in the first direction $F_D$ between the forward end 56A of the first intermediate turbulator 56 and the aft end 58B of the second intermediate turbulator 58, such that the entireties of the intermediate turbulator members 56, 58 are spaced apart from one another in the first direction $F_D$. The forward and aft ends 56A, 56B, 58A, 58B of the intermediate turbulator members 56, 58 in the embodiment shown are also staggered with respect to the forward and aft ends 48A, 48B, 50A, 50B of both of the respective first and second side turbulator members 48, 50 in the corresponding row in the first direction $F_D$. Referring still to FIG. 3, the forward ends 56A, 58A of the first and second intermediate turbulator members are spaced apart from one another in the second direction $S_D$ such that a gap $T_G$ extending in the second direction $S_D$ is formed between the forward ends 56A, 58A of the first and second intermediate turbulator members 56, 58.

According to one aspect of the invention, the first and/or second intermediate turbulator members 56, 58 in each row $R_1, R_2, \ldots R_N$ are arranged at an angle that is generally parallel to one of the respective first and second side turbulator members 48, 50 in the corresponding row. For example, as shown in FIG. 3, the first intermediate turbulator member 56 is arranged at an angle π relative to the first direction $F_D$ that is generally parallel to the angle θ of the first side turbulator member 48 relative to the first direction $F_D$ in the corresponding row. Further as shown in FIG. 3, the second intermediate turbulator member 58 is arranged at an angle Ω relative to the first direction $F_D$ that is generally parallel to the angle β of the second side turbulator member 50 relative to the first direction $F_D$ in the corresponding row.

According to one aspect of the invention, at least a majority of the rows $R_1, R_2, \ldots R_N$ of turbulator members 18 preferably have generally the same configuration of turbulator members 18.

During operation of the engine, cooling fluid, such as, for example, compressor discharge air, may be passed into the cooling passages 16 in a conventional manner. Upon the cooling fluid passing through the cooling passages 16 and meeting the turbulator members 18, the forward ends 56A, 58A of the intermediate turbulator members 56, 58 trip the boundary layer and create turbulence in the cooling fluid. The turbulent cooling fluid forms vortices downstream of the intermediate turbulator members 56, 58, wherein the vortices roll along the length components $L_C$ of the intermediate turbulator members 56, 58. However, the vortices are pushed downstream and away from the intermediate turbulator members 56, 58 by the incoming cooling fluid flowing over the intermediate turbulator members 56, 58. As the vortices propagate along the full length of the downstream sides of intermediate turbulator members 56, 58, the boundary layers become progressively more disturbed or thickened, but the first and second side turbulators 48, 50 disrupt such boundary layer formation, thereby preventing boundary layer growth that significantly reduces heat transfer augmentation. The vortices continue to increase in diameter as they respectively roll away from the intermediate turbulator members 56, 58. The vortices may be disrupted by the respective first and second side turbulators 48, 50 positioned downstream the intermediate turbulator members 56, 58. The rows $R_1$, $R_2$ . . . $R_N$ of turbulator members 18 effectively dissipate convective cooling layers in cooling passages 16 in gas turbine engine components and create higher internal convective cooling potential within the cooling passages 16, thus generating a high rate of internal convective heat transfer and efficient overall cooling system performance. This performance equates to a reduction in cooling air demand and better turbine engine performance.

Figure 4:
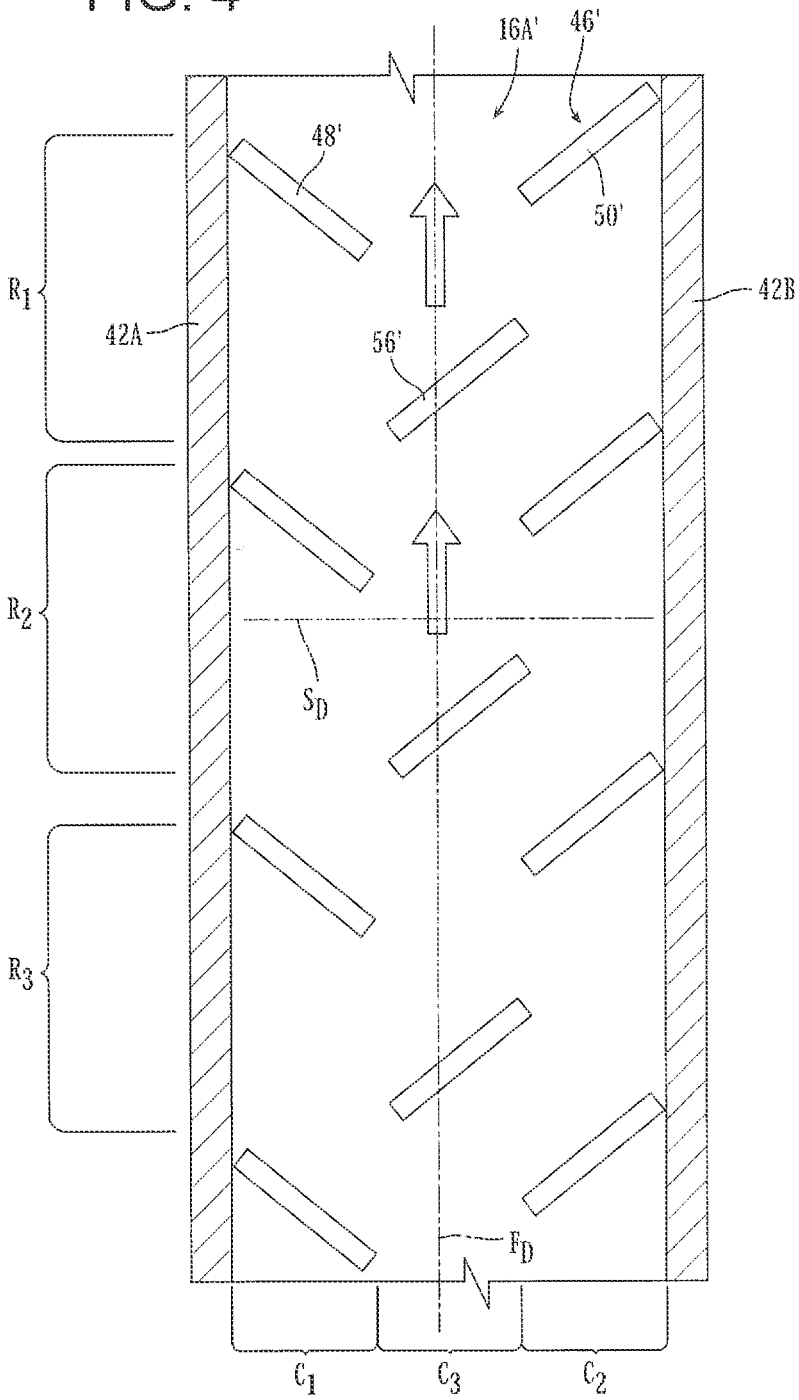
FIGS. 4 and 5 are views similar to the view of FIG. 3 showing cooling systems according to other embodiments of the invention.
Figure 5:
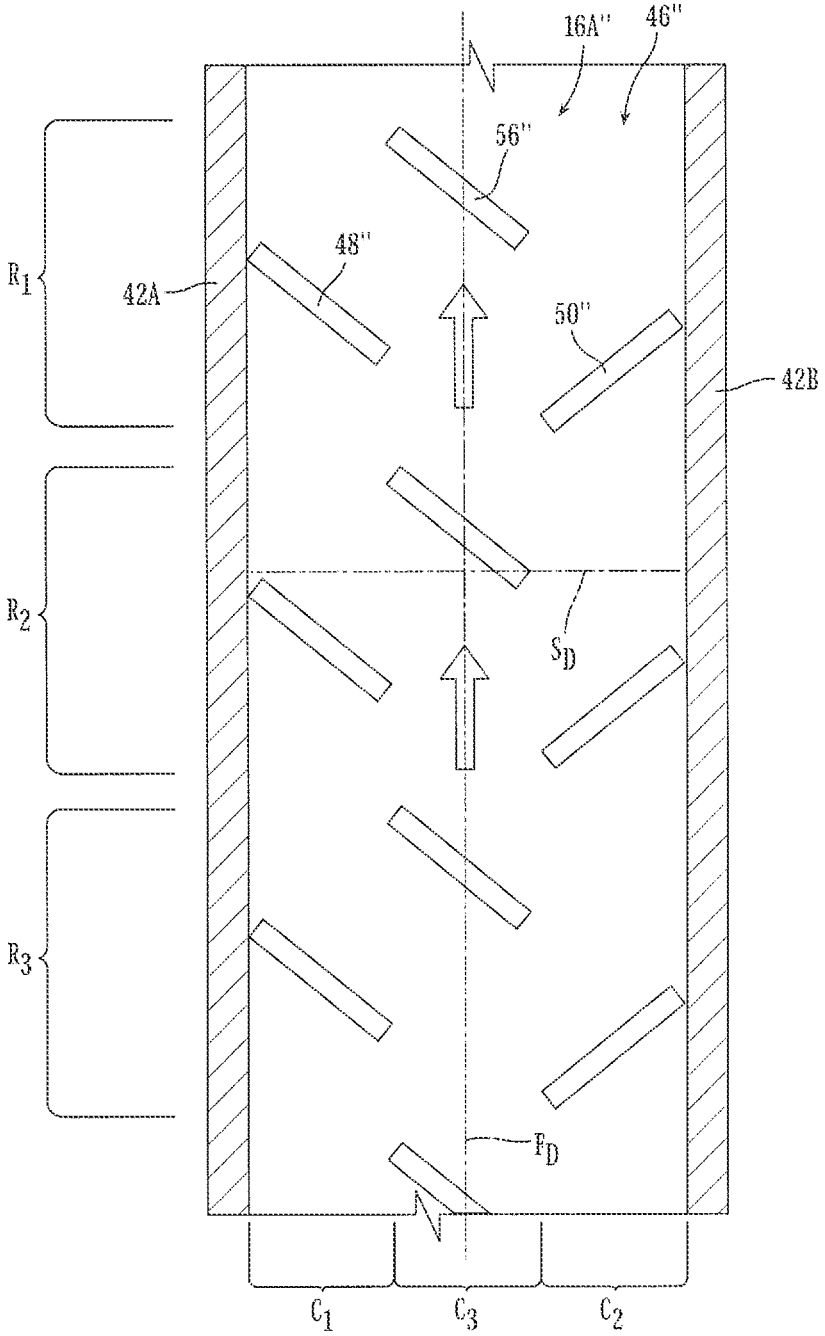

Referring now to FIGS. 4 and 5, cooling passages 16A', 16A" including turbulator systems 46', 46" according to other embodiments of the invention are shown, wherein structure similar to that described above with reference to FIGS. 1-3 includes the same reference number followed by a prime (') symbol in FIG. 4 and a double prime symbol (") in FIG. 5. As shown in FIG. 4, the rows $R_1$, $R_2$, $R_3$ of turbulator members include first and second side turbulator members 48', 50', but only one intermediate turbulator member 56'. The intermediate turbulator member 56' is arranged to be generally parallel to the second side turbulator member 50' in this embodiment, and is offset with respect to both the first and second side turbulator members 48', 50' in the first direction $F_D$.

As shown in FIG. 5, the rows $R_1$, $R_2$, $R_3$ of turbulator members include first and second side turbulator members 48", 50", but only one intermediate turbulator member 56". The intermediate turbulator member 56" shown in FIG. 5 is arranged to be generally parallel to the first side turbulator member 48", and is offset with respect to both the first and second side turbulator members 48", 50" in the first direction $F_D$.

As shown in FIGS. 4 and 5, the turbulator systems 46', 46" are arranged in three columns comprising a first side column $C_1$, a second side column $C_2$, and a center column $C_3$. The first side column $C_1$ includes the first side turbulator members 48' and 48", the second side column $C_2$ includes the second side turbulator members 50' and 50", and the center column $C_3$ includes the intermediate turbulator members 56' and 56". As clearly shown in FIG. 4, the intermediate turbulator members 56' in the center column $C_3$ of the turbulator system 46' are generally parallel to one another and to the second side turbulator members 50' of the second side column $C_2$, and as clearly shown in FIG. 5, the intermediate turbulator members 56" in the center column $C_3$ of the turbulator system 46" are generally parallel to one another and to the first side turbulator members 48" of the first side column $C_1$.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cooling passage defined between first and second spaced apart sidewalls of a turbine engine component, the first and second sidewalls extending generally in a first direction with a second direction defined between the first and second sidewalls, the cooling passage comprising:

a turbulator system including a plurality of rows of turbulator members, each row comprising:

a first side turbulator member having an aft end that extends from the first sidewall such that the first side turbulator member extends from the first sidewall at an angle of about 15 degrees to about 75 degrees relative to the first direction, wherein a forward end of the first side turbulator member is upstream from the aft end in the first direction and is distal from the first sidewall;

a second side turbulator member having an aft end that extends from the second sidewall such that the second side turbulator member extends from the second sidewall at an angle of about −15 degrees to about −75 degrees relative to the first direction, wherein a forward end of the second side turbulator member is upstream from the aft end in the first direction and is distal from the second sidewall;

wherein the first and second side turbulator members are arranged such that a space having a component in the second direction is defined therebetween, and wherein the first and second side turbulator members are staggered with respect to one another in the first direction such that the respective forward and aft ends thereof are offset from one another in the first direction; and first and second elongate intermediate turbulator members, each having a direction of elongation at least partially extending in the second direction and located at least partially in the space between the first and second side turbulator members, wherein inner and outer ends of each of the first and second intermediate turbulator members are staggered with respect to the forward and aft ends of both of the respective first and second side turbulator members in the first direction, and wherein the inner ends of the first and second intermediate turbulator members are spaced apart from one another in the second direction such that a gap in the second direction is formed therebetween;

wherein the first and second side turbulator members and the first and second intermediate turbulator members having generally squared corners so as to provide the first and second side turbulator members and the first and second intermediate turbulator members with a generally rectangular shape.

2. The cooling passage according to claim 1, wherein the first and second side turbulator members in each row are generally oppositely angled with respect to one another relative to the first direction.

3. The cooling passage according to claim 1, wherein a gap extending in the first direction is formed between the inner ends of the first and second intermediate turbulator members in each row.

4. The cooling passage according to claim 1, wherein the first and second intermediate turbulator members in each row are arranged at respective angles that are each generally parallel to one of the respective first and second side turbulator members in the corresponding row.

5. The cooling passage according to claim 1, wherein the first and second intermediate turbulator members in each row are staggered with respect to one another in the first direction, such that the respective inner and outer ends thereof are offset from one another in the first direction.

6. The cooling passage according to claim 1, wherein at least a majority of the rows have generally the same configuration of turbulator members.

7. A cooling passage defined between first and second spaced apart sidewalls of a turbine engine component, the first and second sidewalls extending generally in a first direction with a second direction defined between the first and second sidewalls, the cooling passage comprising:

a turbulator system including a plurality of rows of turbulator members, each row comprising:

a first side turbulator member extending from the first sidewall at an angle of about 15 degrees to about 75 degrees relative to the first direction;

a second side turbulator member extending from the second sidewall at an angle of about −15 degrees to about −75 degrees relative to the first direction, wherein the first and second side turbulator members are arranged such that a space having a component in the second direction is defined therebetween, and wherein the first and second side turbulator members are staggered with respect to one another in the first direction such that respective forward and aft ends thereof are offset from one another in the first direction; and first and second elongate intermediate turbulator members, the first intermediate turbulator member being downstream from the second intermediate turbulator member in the first direction, each elongate intermediate turbulator member having a direction of elongation at least partially extending in the second direction and located at least partially in the space between the respective first and second side turbulator members;

wherein:

forward and aft ends of the first and second intermediate turbulator members are staggered with respect to each of the forward and aft ends of both of the respective first and second side turbulator members in the first direction;

the forward and aft ends of the first and second intermediate turbulator members are staggered with respect to one another in the first direction such that the respective forward and aft ends thereof are offset from one another in the first direction;

a gap is formed in the first direction between the aft end of the second intermediate turbulator member and the forward end of the first intermediate turbulator member; and the first and second side turbulator members and the first and second intermediate turbulator members having generally squared corners so as to provide the first and second side turbulator members and the first and second intermediate turbulator members with a generally rectangular shape.

8. The cooling passage according to claim 7, wherein the first and second intermediate turbulator members in each row are generally oppositely angled with respect to one another relative to the first direction.

9. The cooling passage according to claim 8, wherein the first and second intermediate turbulator members in each row are arranged at an angle that is generally parallel to one of the respective first and second side turbulator members in the corresponding row.

10. The cooling passage according to claim 8, wherein the first and second side turbulator members in each row are generally oppositely angled with respect to one another relative to the first direction.

11. The cooling passage according to claim 1, wherein the entireties of the first and second intermediate turbulator members are spaced apart from one another in the first direction.

12. The cooling passage according to claim 7, wherein the entireties of the first and second intermediate turbulator members are spaced apart from one another in the first direction.

13. The cooling passage according to claim 7, wherein the forward ends of the first and second intermediate turbulator members are spaced apart from one another in the second direction such that a gap in the second direction is formed therebetween.

14. An airfoil in a turbine engine comprising:

a main body including a leading edge, a trailing edge, a pressure sidewall, a suction sidewall, and a hollow interior portion;

opposed first and second sidewalls in the hollow interior portion and extending generally parallel to one another in a first direction with a second direction defined between the first and second sidewalls, the first and second sidewalls defining a cooling passage therebetween; and a turbulator system provided in the cooling passage, the turbulator system including a plurality of rows of turbulator members and only three columns including a first side column, a second side column, and a center column, each row comprising:

a first side turbulator member located in the first side column and extending from the first sidewall at an angle of about 15 degrees to about 75 degrees relative to the first direction;

a second side turbulator member located in the second side column and extending from the second sidewall at an angle of about −15 degrees to about −75 degrees relative to the first direction, wherein the first and second side turbulator members are arranged such that a space having a component in the second direction is defined therebetween, and wherein the first and second side turbulator members are staggered with respect to one another in the first direction, such that respective forward and aft ends thereof are offset from one another in the first direction; and an elongate intermediate turbulator member located in the center column and at least partially in the space between the first and second side turbulator members, wherein the intermediate turbulator member in each row extends generally parallel to one of first and second side turbulator members in the corresponding row, and each intermediate turbulator member is generally parallel to each other;

wherein at least a majority of the rows have generally the same configuration of turbulator members; and wherein the first and second side turbulator members and the intermediate turbulator members have generally squared corners so as to provide the first and second side turbulator members and the intermediate turbulator members with a generally rectangular shape.

15. The airfoil according to claim 14, wherein the first and second side turbulator members in each row are generally oppositely angled with respect to one another relative to the first direction.

16. The cooling passage according to claim 14, wherein the intermediate turbulator member in each row is staggered with respect to each of the first and second side turbulator members in the first direction, such that the respective forward and aft ends thereof are offset from one another in the first direction.

* * * * *